United States Patent [19]

Mosby, Jr.

[11] 4,236,539

[45] Dec. 2, 1980

[54] SMOKING APPARATUS

[75] Inventor: John S. Mosby, Jr., 2008 Christie La., Carrollton, Tex. 75006

[73] Assignees: John S. Mosby, Jr.; L. Gregg Sealy, both of Dallas, Tex.

[21] Appl. No.: 946,198

[22] Filed: Sep. 27, 1978

[51] Int. Cl.[3] ..... A24D 1/12; A24D 1/30

[52] U.S. Cl. ..... 131/175; 131/225; 131/242

[58] Field of Search ..... 131/175, 174, 242, 178, 131/231, 225, 240 R

[56] References Cited

U.S. PATENT DOCUMENTS

| | | | |
|---|---|---|---|
| 1,579,703 | 4/1926 | Grant | 131/175 |
| 2,108,218 | 2/1938 | Stultz | 131/175 |
| 2,894,514 | 7/1959 | Moore | 131/174 |
| 3,336,929 | 8/1967 | Williams | 131/175 |
| 3,543,768 | 1/1970 | Law | 131/175 |
| 4,134,409 | 1/1979 | McManus | 131/171 |

*Primary Examiner*—Stephen C. Pellegrino

*Attorney, Agent, or Firm*—W. Thomas Timmons

[57] ABSTRACT

A smoking apparatus that appears to be a conventional drink container with a suitable cover and mouthpiece is disclosed. A cigarette or the like is held within the conventional drink container so that a continuous passageway is formed from the cigarette or the like to the mouthpiece, allowing the cigarette or the like to be smoked while it is in the conventional drink container by puffing on the mouthpiece. Either a wall of the conventional drink container or the cover forms at least one ventilation hole. A receptacle inside the conventional drink container collects residue of the cigarette or the like. In one arrangement, the smoking apparatus appears to be a cold drink cup with a lid and straw sticking through the lid. The receptacle is made of a metallic foil, and the cigarette is held in a downward direction by a plumbing insert. A second plumbing insert goes through the hole in the lid with the lip of the insert resting on top of the lid, and holds the straw. A plumbing fitting connects the two inserts together.

8 Claims, 3 Drawing Figures

SMOKING APPARATUS

BACKGROUND OF THE INVENTION

1. Field of the Invention

The present invention relates generally to smoking apparatus and in one of its aspects to a smoking apparatus that appears to be a conventional drink container.

2. Description of the Prior Art

In recent years, hostility has steadily grown against smoking in public places and in areas where there is even slight crowding. Even at parties, where there are many people standing around holding drinks in their hands, smokers are put upon by others present both because of the smoke itself and because of the difficulty of maneuvering the lighted tip of a cigarette or other smoking article in a crowd of people.

In the past, a number of smoking apparatus had been developed that substantially conceal the cigarette as shown in U.S. Pat. No. 2,561,626 issued to Hutcheson, U.S. Pat. No. 2,764,164 issued to Coffey and U.S. Pat. No. 3,362,415 issued to Ellis. Such devices were developed for a variety of reasons, such as being safety devices and not showing the lit tip of the cigarette in the dark for blackout conditions. All of the devices, however, still looked like smoking devices, and when someone used one of the devices, there was no question but that the person was smoking.

Other smoking devices, such as shown in U.S. Pat. No. 2,626,613 issued to Glance and U.S. Pat. No. 2,894,514 issued to Moore disclose devices that leave the smoking tip of the cigarette exposed. Such devices were intended primarily as safety devices and were made primarily of specially constructed parts.

SUMMARY OF THE INVENTION

A smoking apparatus according to the present invention includes a conventional drink container, a cover for covering the conventional drink container and a mouthpiece positioned to appear to be for drinking from the conventional drink container. A means within the conventional drink container is included for holding a cigarette or the like. The holding means and the mouthpiece are so connected that a continuous passageway is formed from a cigarette or the like held in the holding means through the mouthpiece so that the cigarette or the like can be smoked while it is in the conventional drink container by puffing on the mouthpiece. Either the wall of the conventional drink container or the cover forms at least one ventilation hole. In cases where the conventional drink container is made of a material that is flammable or that smokes or creates an odor when it comes into contact with hot ashes, it is desirable to include a receptacle inside the conventional drink container for residues of the cigarette or the like, made of a non-flammable material. A preferred arrangement of the receptacle is formed open at its upper end, and the receptacle rests upright within the conventional drink container below the cigarette or the like.

A preferred arrangement of a smoking apparatus in accordance with the present invention includes a cold drink cup, a lid for covering the cold drink cup, having a hole therethrough suitable for a straw, a straw positioned to appear to be inserted into the cold drink cup through the hole in the lid, and a means within the cup for holding a cigarette or the like. The means and the straw are so connected that a continuous passageway is formed from the cigarette or the like through the straw whereby the cigarette or the like can be smoked while it is in the cold drink cup by puffing on the straw. Thus, a user of the present invention can appear to be drinking from the cup through the straw, whereas he can actually be smoking a cigarette or the like. A suitable non-flammable receptacle for residues of the cigarette or the like can be made from a metallic foil. One means for holding a cigarette or the like includes a plumbing insert for holding the cigarette or the like in a downward direction, a plumbing insert for holding the straw, and a plumbing fitting connecting the two inserts together. The plumbing insert for holding the straw goes through the hole in the lid with the lip of the plumbing insert resting on top of the lid. The lid is tightened between the lip of the plumbing insert and the plumbing fitting.

These and other objects, advantages and features of this invention will be apparent from the following description taken with reference to the accompanying drawings, wherein is shown the preferred embodiments of the invention.

DETAILED DESCRIPTION

Figure 1:
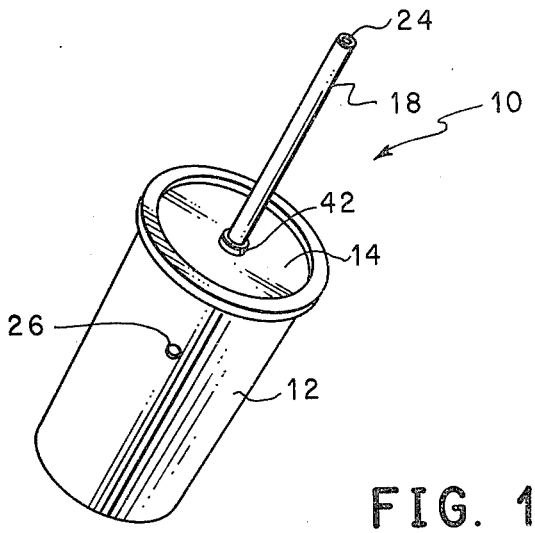
FIG. 1 is a perspective view of a smoking apparatus in accordance with the present invention.
Figure 2:
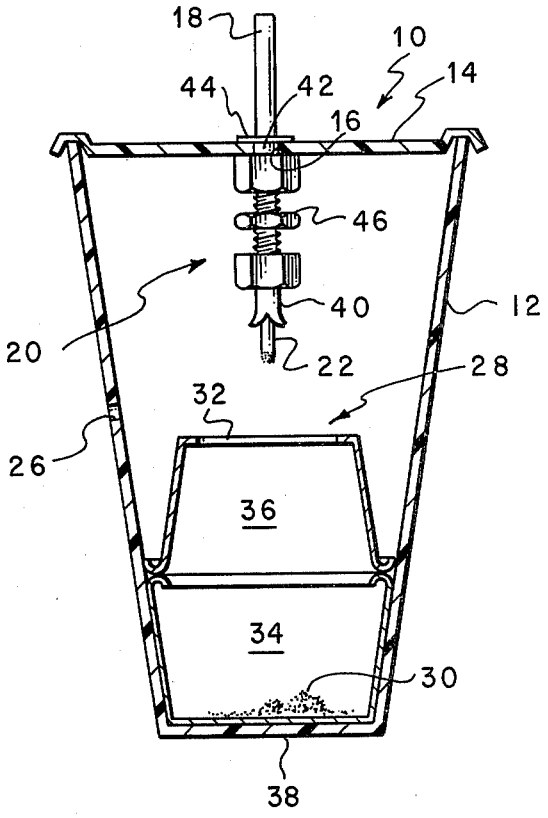
FIG. 2 is a side view partly in section of a smoking apparatus of the present invention.
Figure 3:
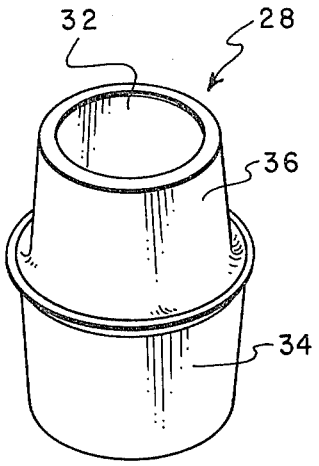
FIG. 3 is an isometric view of a receptacle for use in a smoking apparatus according to the present invention.

Referring now to the drawings, a preferred embodiment of a smoking apparatus according to the present invention is referred to generally by reference numeral 10. Smoking apparatus 10 includes a cold drink cup 12 and a lid 14 for covering the cold drink cup. Lid 14 forms a hole 16 suitable for a straw. Smoking apparatus 10 also includes a straw 18 positioned to appear to be inserted into cold drink cup 12 through hole 16 in lid 14, and a means 20 within cup 12 for holding a cigarette 22 or the like. Holding means 20 and straw 18 are so connected that a continuous passageway 24 is formed from cigarette 22 or the like through straw 18 so that cigarette 22 or the like can be smoked while it is in cold drink cup 12 by puffing on straw 18.

The wall of cold drink cup 12 forms at least one ventilation hole 26 to allow air into cup 12 and smoke to escape from cup 12. At least one ventilation hole 26 could have been formed in lid 14 also, but by forming at least one ventilation hole 26 in cold drink cup 12, the ventilation hole can be easily covered by a finger of a person holding the cup, using the hand used for holding the cup. By forming at least one ventilation hole 26 in a place where it can be easily covered by a finger of the holding hand, it makes it possible for a user of smoking apparatus 10 to easily prevent smoke from escaping from the smoking apparatus.

A preferred embodiment of smoking apparatus 10 also includes a receptacle 28 inside cold drink cup 12 for residues 30 of cigarette 22 or the like. Receptacle 28 should be made of a non-flammable material that does not burn or smoke when in contact with hot ashes such as residues 30. Receptacle 28 is formed open at its upper end 32 and rests upright within cold drink cup 12 below cigarette 22 or the like. One arrangement of receptacle 28 can be constructed from metallic foil fruitcake cups 34 and 36, with fruitcake cup 34 resting upright on the bottom 38 of cold drink cup 12 and the top fruitcake cup 36 resting upside down on bottom fruitcake cup 34. What would have been the bottom of fruitcake cup 36 is removed to form opening 32.

One preferred embodiment of means 20 for holding cigarette 22 or the like includes a plumbing insert 40 for holding cigarette 22 or the like in a downward direction, and a plumbing insert 42 for holding straw 18. Plumbing insert 42 goes through hole 16 in lid 14 with lip 44 of plumbing insert 42 resting on top of lid 14. Holding means 20 also includes a plumbing fitting 46 connecting the two inserts together.

In general, cold drink cup 12 is one example of a conventional drink container, lid 14 is one example of a cover for covering the conventional drink container of a type normally suitable for such a conventional drink container, and straw 18 is one example of a mouthpiece positioned to appear to be for drinking from the conventional container of a type normally suitable for such a conventional drink container and cover. The holding means and the mouthpiece are so connected that a continuous passageway is formed from a cigarette or the like held in the holding means through the mouthpiece so that the cigarette or the like can be smoked while it is in the conventional drink container by puffing on the mouthpiece. Another example of a smoking apparatus according to the present invention would be a conventional drink container comprising a cold drink bottle and a mouthpiece comprising a straw. In such an arrangement, since there is usually no cover on an open cold drink bottle with a straw in it, the cover of a type normally suitable for such a conventional drink container would be the neck of the bottle or a cover hidden in the neck of the bottle so that the straw would appear to be supported by the bottle rather than the cover.

It can now be seen that a smoker using a smoking apparatus according to the present invention can smoke in public without drawing attention to the fact that he is smoking. Furthermore, a smoking apparatus according to the present invention also is a safety device that will help prevent cigarette burns in furniture and clothing as well as preventing possible cigarette burns. It is a safety device that can be constructed entirely from readily available parts.

Another possible variation in the use of the present invention is to add some water in the bottom of the receptacle, or simply do away with the receptacle and add some water in the bottom of the conventional drink container. The residues of the cigarette or the like are thus extinguished as soon as they drop from the cigarette or the like into the water.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is comtemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A smoking apparatus comprising, in combination:
a conventional drink container;
a cover for covering the conventional drink container of a type normally suitable for such a conventional drink container, forming a hole therethrough;
a mouthpiece positioned to appear to be for drinking from the conventional drink container of a type normally suitable for such a conventional drink container and cover;
a plumbing insert for holding a cigarette or the like in a downward direction inside of the conventional drink container;
a plumbing insert for holding the mouthpiece, going through the hole in the cover, the lip of the plumbing insert resting on top of the cover; and
a plumbing fitting connecting the two inserts together, whereby the plumbing insert for holding the cigarette or the like and the mouthpiece are so connected that a continuous passageway is formed from a cigarette or the like held in the insert through the mouthpiece whereby the cigarette or the like can be smoked while it is in the conventional drink container by puffing on the mouthpiece.

2. A smoking apparatus according to claim 1 wherein the wall of the conventional drink container forms at least one ventilation hole.

3. A smoking apparatus according to claim 1 wherein the cover forms at least one ventilation hole.

4. A smoking apparatus according to claim 1 further comprising a receptacle completely inside the conventional drink container for residues of the cigarette or the like, made of non-flammable material, formed open at its upper end wherein the receptacle rests upright within the conventional drink container below the cigarette or the like.

5. A smoking apparatus comprising, in combination:
a cold drink cup;
a lid for covering the cold drink cup, forming a hole therethrough suitable for a straw;
a straw positioned to appear to be inserted into the cold drink cup through the hole in the lid;
a plumbing insert for holding a cigarette or the like in a downward direction inside of the cold drink cup;
a plumbing insert for holding the straw, going through the hole in the lid, the lip of the plumbing insert resting on top of the lid; and
a plumbing fitting connecting the two inserts together, whereby the plumbing insert for holding the cigarette or the like and the straw are so connected that a continuous passageway is formed from the cigarette or the like through the straw whereby the cigarette or the like can be smoked while it is in the cold drink cup by puffing on the straw.

6. A smoking apparatus according to claim 5 wherein the wall of the cold drink cup forms at least one ventilation hole.

7. A smoking apparatus according to claim 5 wherein the lid forms at least one ventilation hole.

8. A smoking apparatus according to claim 5 further comprising a receptacle completely inside the cold drink cup for residues of the cigarette or the like, made of non-flammable material, formed open at its upper end wherein the receptacle rests upright within the cold drink cup below the cigarette or the like.

* * * * *